US009596969B2

(12) United States Patent
Kooijman et al.

(10) Patent No.: US 9,596,969 B2
(45) Date of Patent: Mar. 21, 2017

(54) VACUUM CLEANING DEVICE, COMPRISING A UNIT WITH A MOVABLE SURFACE FOR GENERATING AN OSCILLATING AIRFLOW

(75) Inventors: Gerben Kooijman, Heeze (NL); Jan Frederik Suijver, Dommelen (NL); Okke Ouweltjes, Eindhoven (NL); Jeroen Herman Lammers, Eindhoven (NL)

(73) Assignee: KONINKLIJKE PHILIPS N.V., Eindhoven (NL)

( * ) Notice: Subject to any disclaimer, the term of this patent is extended or adjusted under 35 U.S.C. 154(b) by 706 days.

(21) Appl. No.: 13/995,712

(22) PCT Filed: Dec. 27, 2011

(86) PCT No.: PCT/IB2011/055960
§ 371 (c)(1),
(2), (4) Date: Jun. 19, 2013

(87) PCT Pub. No.: WO2012/093318
PCT Pub. Date: Jul. 12, 2012

(65) Prior Publication Data

US 2013/0269151 A1 Oct. 17, 2013

(30) Foreign Application Priority Data

Jan. 6, 2011 (EP) ..... 11150276

(51) Int. Cl.
*A47L 5/00* (2006.01)
*A47L 9/10* (2006.01)
(Continued)

(52) U.S. Cl.
CPC ..... *A47L 9/106* (2013.01); *A47L 5/14* (2013.01); *A47L 9/0072* (2013.01); *A47L 9/02* (2013.01); *A47L 9/0483* (2013.01); *B08B 5/02* (2013.01)

(58) Field of Classification Search
CPC . A47L 5/14; A47L 9/02; A47L 9/0483; A47L 9/106; B08B 5/02
(Continued)

(56) References Cited

U.S. PATENT DOCUMENTS 4,594,749 A 6/1986 Waterman
5,400,466 A 3/1995 Alderman et al.
(Continued)

FOREIGN PATENT DOCUMENTS

DE 4035411 A1 5/1992
GB 2393384 A 3/2004
(Continued)

OTHER PUBLICATIONS

R. Holman et al, "Formation Criterion for Synthetic Jets"; AIAA Journal, vol. 43 (10), pp. 2110-2116, 2005.
(Continued)

*Primary Examiner* — David Redding

(57) ABSTRACT

A vacuum cleaning device comprises a unit (1) for aerodynamically affecting dust particles and/or a surface (40) to be cleaned in order for the particles to become dislodged from the surface (40) and to be received by the unit (1). The unit (1) comprises a housing (10) having an internal space (11) enclosed by a housing wall (12) in which at least one opening (13) is arranged, a movable surface (30) which is integrated in the housing wall (12), and means (31) for actuating the movable surface (30), which are adapted to realize an oscillating movement of the surface (30) that causes air to alternately be drawn into the housing (10) through the opening (13) and expelled from the housing (10) through the opening (13). At least a portion of the housing
(Continued)

wall (12), particularly a portion of the housing wall (12) in which the opening (13) is located, is movably arranged in the unit (1).

14 Claims, 4 Drawing Sheets

(51) Int. Cl.

| | |
|---|---|
| ***A47L 5/14*** | (2006.01) |
| ***A47L 9/00*** | (2006.01) |
| ***A47L 9/02*** | (2006.01) |
| ***A47L 9/04*** | (2006.01) |
| ***B08B 5/02*** | (2006.01) |

(58) Field of Classification Search
USPC ..... 15/382
IPC ..... A47L 5/00
See application file for complete search history.

(56) References Cited

U.S. PATENT DOCUMENTS

| | | | |
|---|---|---|---|
| 7,228,590 | B2 | 6/2007 | Bosses |
| 7,228,591 | B2 | 6/2007 | Bosses |
| 7,383,607 | B2 | 6/2008 | Johnson |
| 2005/0278890 | A1 | 12/2005 | Bosses |

FOREIGN PATENT DOCUMENTS

| | | | |
|---|---|---|---|
| JP | 49134658 | U | 11/1974 |
| JP | 2003000496 | A | 1/2003 |
| WO | 2010065115 | A2 | 6/2010 |

OTHER PUBLICATIONS

J.M. Shuster et al, A Study of the Formation and Scaling of a Synthetic Jet; AIAA Paper 2004-0090, 2004.

VACUUM CLEANING DEVICE, COMPRISING A UNIT WITH A MOVABLE SURFACE FOR GENERATING AN OSCILLATING AIRFLOW

FIELD OF THE INVENTION

The present invention relates to a vacuum cleaning device, comprising a unit for aerodynamically affecting dust particles and/or a surface to be cleaned in order for the particles to become dislodged from the surface and to be received by the unit.

BACKGROUND OF THE INVENTION

Vacuum cleaning is a well-known method for removing dust from surfaces, particularly floors. In general, in the field of vacuum cleaning, a suction force is generated and applied for forcing dust and particles to move from a surface to be cleaned to another location such as a canister for collecting the particles. In the process, it may be desirable to agitate the surface in order to facilitate removal of the particles from the surface under the influence of the suction force as mentioned. To that end, it is possible to use a tool for actually contacting the surface to be cleaned. However, it is also known to use another technique, namely a technique which involves the use of a kind of air pump, wherein air waves are generated for vibrating the surface, which can help in releasing dust particles from the surface.

U.S. Pat. No. 7,383,607 discloses an agitation apparatus which is suitable for use in a cleaning head of a vacuum cleaner, and which includes first and second flow paths. Each of these flow paths has a resonant cavity and an inlet/outlet port which joins the cavity to a space within the cleaning head. A generator, such as a loudspeaker with a diaphragm, generates an alternating pressure wave between the ports. Pressure waves are emitted from one of the ports in an anti-phase relationship with the pressure waves from the other of the ports, thus reducing operating noise. When the vacuum cleaner of which the agitation apparatus is part is used for cleaning a carpet, the air motion to/from the ports vibrates the pile of the carpet and serves to draw out dust from between the carpet fibers.

U.S. Pat. No. 7,383,607 teaches that in the known agitation apparatus, the frequency of the oscillating airflow is preferably chosen such as to be at the resonant frequency of the carpet to be cleaned. Therefore, it is preferred if the frequency of operation is variable.

It is noted that the agitation apparatus known from U.S. Pat. No. 7,383,607 helps in releasing dust from a carpet, but it is not capable of effectively freeing dust from inside a carpet and making it airborne. This cannot be done by only causing a vibration as mentioned, even if a frequency at which the vibration takes place is in the resonant range.

SUMMARY OF THE INVENTION

It is an object of the present invention to provide a vacuum cleaning device comprising a unit for freeing dust from a surface to be cleaned which is of the same type as the device known from U.S. Pat. No. 7,383,607 as far as the use of a movable surface for generating air movement is concerned, however, which is much more effective. The object is achieved by means of a vacuum cleaning device which comprises a unit for aerodynamically affecting dust particles and/or a surface to be cleaned in order for the particles to become dislodged from the surface and to be received by the unit, wherein the unit comprises a housing having an internal space enclosed by a housing wall in which at least one opening is arranged, a movable surface which is integrated in the housing wall, and means for actuating the movable surface, which are adapted to realize an oscillating movement of the surface that causes air to alternately be drawn into the housing through the opening, and expelled from the housing through the opening, and wherein at least a portion of the housing wall, particularly a portion of the housing wall in which the opening is located, is movably arranged in the unit.

According to the present invention, the position of the opening in the unit can be varied, due to the fact that the opening is arranged in a movable component of the unit, which is the housing wall, or at least a portion thereof. Hence, it is possible to operate the unit in such a way that the position of the opening with respect to a surface to be cleaned is constantly set such as to enable a most effective use of the airflow at various stages of the oscillating movement of the movable surface. In particular, it is possible to continuously switch the position of the opening between a position in which it is directed towards the surface to be cleaned and a position in which it is directed away from the surface, and back, wherein it is advantageous if the opening is put in the first position when there is an intake of air into the housing, and in the second position when there is an outflow of air from the housing. In this way, it is achieved that there can be an effective pick-up of dust particles, while at the same time, dust particles are prevented from being blown back to the surface from which they have just been removed.

Advantageously, the unit comprises means for imposing a repetitive movement on the movably arranged portion of the housing wall. When such means are used and operated, it is possible to actually realize a situation in which a movement of the movably arranged portion of the housing wall and an oscillating movement of the movable surface are adapted to each other in an appropriate way. For example, the movably arranged portion of the housing wall may be rotatably arranged, and the movement imposing means may be adapted to impose a rotating movement on the movably arranged portion of the housing wall. It is also possible for the movement imposing means to be adapted to impose an oscillating movement on the movably arranged portion of the housing wall. In any case, effective dust removal results are obtained when the actuating means are adapted to realize an oscillating movement of the movable surface at a predetermined frequency, wherein the movement imposing means are adapted to realize a repetitive movement of the movably arranged portion of the housing wall at the same frequency. In that case, a position in which the opening is directed towards a surface to be cleaned can be associated with an inflow of air, and a position in which the opening is directed away from the surface can be associated with an outflow of air, continuously during the oscillating movement of the movable surface, as already explained in the foregoing.

Within the scope of the present invention, various options exist for realizing a synchronization of the frequencies of the movements of the movable surface and the movably arranged portion of the housing wall. A robust and reliable relation between the two movements can be obtained when there is a mechanical link. For example, the unit may comprise means which are adapted to move along with the movably arranged portion of the housing wall, and to mechanically transfer a substantial fraction of the movement to the movable surface. A practical embodiment of such means is a cam construction.

In a common way of applying the present invention, the unit comprises a rotatable cylinder, wherein the cylinder wall functions as the movably arranged portion of the housing wall, and wherein the movable surface is driven with a sinusoidal signal with a frequency identical to the rotation frequency of the cylinder. In that case, air intake takes place during one half of the rotation, and air outflow takes place during another half of the rotation. In the process, the opening is facing a surface to be cleaned for less than half of the rotation during which air intake takes place, assuming that the surface is planar, which is the case in many practical situations. Hence, ineffective dust suction takes place. This can be avoided by making the movable surface move only during a part of the rotation of the cylinder, which can be realized when the actuating means are adapted to realize an intermittent movement of the surface. Another solution is found in having a flexible component as a part of the movably arranged portion of the housing wall, wherein the opening is arranged in the flexible component. The flexible component may be used for contacting a surface to be cleaned during a substantive part of the rotation of the cylinder.

At the position where the opening is located in the movably arranged portion of the housing wall, means may be provided for agitating a surface to be cleaned. These means may be simple mechanical means, and may comprise an edge delimiting the opening, or a protrusion such as a lip, for example. Furthermore, it may be so that means for agitating a surface to be cleaned during a movement of the movably arranged portion of the housing wall are arranged on an external surface of the movably arranged portion of the housing wall. Such means may comprise brush hairs, for example.

As already noted in the foregoing, the movably arranged portion of the housing wall can be shaped like a cylinder wall. Normally, a cylinder has two end walls and a side wall extending between the end walls. In the case of the cylinder shape of the movably arranged portion of the housing wall, the side wall may have a circular circumference, but an elliptical circumference is possible as well. In the latter case, an additional benefit of enhanced mechanical agitation of the surface to be cleaned may be obtained during rotation or oscillation of the cylinder wall. Also, the opening can be shaped like a slit extending along at least a substantial length of the side wall, and the movable surface can be arranged in one of the end walls. Nevertheless, it is also possible that two or more openings are provided, regardless of the shape of the movably arranged portion of the housing wall.

Furthermore, in the case of the cylinder shape of the movably arranged portion of the housing wall, it is possible that this portion also comprises a tube-shaped element which is arranged on the side wall, wherein the opening is located at an end of the tube-shaped element. The tube-shaped element may help in determining a direction of an outgoing flow of air, and may have a substantially radial orientation with respect to a longitudinal axis of the cylinder wall, but other orientations are feasible as well, including a substantially tangential orientation.

Preferably, the movable surface is actuated in such a way that there is an asymmetry between the suction and the blowing phases, wherein the unit which is part of the vacuum cleaning device according to the present invention may be regarded as means for generating a so-called synthetic jet. This is the case when the actuating means are adapted to realize an oscillating movement of the movable surface that causes air to alternately be drawn into the housing through the opening from various directions at the opening, and expelled from the housing through the opening in the form of a directed jet. It is very well possible to use the outgoing directed jet of air for transporting dust particles to a desired position, wherein the traditional suction airflow generated by a fan or the like in conventional vacuum cleaning devices may be omitted.

At a given vibration frequency and a given geometry of the opening in the wall of the housing of the unit, the directed jet of air is formed when the velocity of the air through the opening is high enough. A generally known number which is applicable here is the so-called Strouhal number, which is defined as follows:

$$Sr = \frac{f * d}{v}$$

in which Sr is the Strouhal number, f is a frequency of the movement of the surface which is part of the unit, d is a characteristic dimension of the opening, and v is an average velocity of the air in the opening in an outflow phase of a cycle of drawing in and expelling air. Generally speaking, for the purpose of ensuring that a synthetic jet is realized, it is advantageous if the Strouhal number is below a certain maximum, wherein the value of this maximum is related to the characteristics of the opening concerned, particularly the shape of the opening. If the opening is an axis-symmetric opening, for example, a circular opening, it is preferred if the following criterion is met: $Sr \leq 1$, and it is more preferred if the following criterion is met: $Sr \leq 0.5$. In that case, the diameter of the opening is the characteristic dimension. Furthermore, if the opening has an elongated rectangular shape, with a long side which is at least 10 times longer than a short side, it is preferred if the following criterion is met: $Sr \leq 0.25$, and it is more preferred if the following criterion is met: $Sr \leq 0.1$. In that case, the length of the short side of the opening is the characteristic dimension. In general, it is preferred if the Strouhal number Sr is not higher than 1.

In principle, the opening can have any suitable shape. An example of another possibility than an axis-symmetric shape and an elongated rectangular shape is a square shape. In that case, the length of a side of the opening is the characteristic dimension. When designing an opening with a square shape, it is practical to make use of the criterion which is applicable to the case of the axis-symmetric shape. When designing an opening with a rectangular shape which is not necessarily an elongated rectangular shape, and also not a square shape, it is a feasible option to make use of the criterion which is applicable to the case of the elongated rectangular shape.

For sake of completeness, it is noted that the following two publications are relevant in the field of jet formation criteria:

R. Holman, Y. Utturkar, R. Mittal, B. L. Smith, and L. Cattafesta; *Formation Criterion for Synthetic Jets*; AIAA Journal, vol. 43(10), pp. 2110-2116, 2005; and J. M. Shuster, and D. R. Smith; *A Study of the Formation and Scaling of a Synthetic Jet*; AIAA Paper 2004-0090, 2004.

It is possible to use a filter for protecting the internal space of the housing and the opening from contamination. When this is done, the risk of too much dust entering the space and damaging the movable surface inside is minimized, while the air flow characteristics are maintained.

Within the context of the present invention, many practical embodiments are feasible, wherein the fact that the position of the opening which is arranged in the housing wall and/or the orientation of a portion of the housing wall in which the opening is arranged are variable may be used for various purposes which are advantageous in the field of vacuum cleaning, including the purpose of sucking up dust particles at a position which is very nearby a surface to be cleaned, and emitting the particles for further transport at another position, wherein renewed contamination of the surface with the particles is avoided.

The above-described and other aspects of the present invention will be apparent from and elucidated with reference to the following detailed description of embodiments of a unit which is intended to be used in a vacuum cleaning device.

BRIEF DESCRIPTION OF THE DRAWINGS

The present invention will now be explained in greater detail with reference to the figures, in which equal or similar parts are indicated by the same reference signs, and in which.

It is noted that in all of the figures, arrows are used to indicate directions of relevant airflows and directions of relevant movements.

DETAILED DESCRIPTION OF EMBODIMENTS

Figure 1:
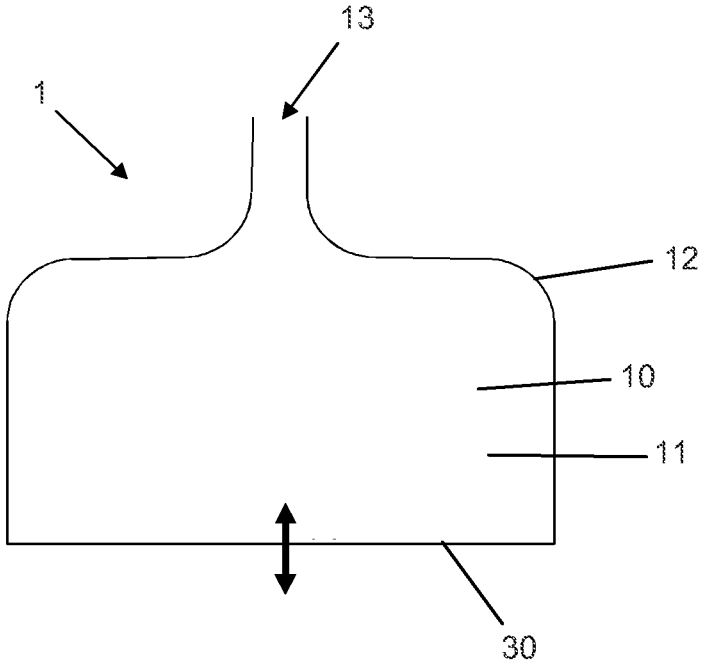
FIG. 1 diagrammatically shows a basic layout of a unit which is intended to be used in a vacuum cleaning device.

FIG. 1 diagrammatically shows a basic outline of a unit 1 which is intended to be used in a vacuum cleaning device, and serves to illustrate the essence of the operation of the unit 1. In a vacuum cleaning device (not shown in the figures), the unit 1 is used at the position of a nozzle of the device where the action of removing dust from a surface to be cleaned takes place. In the following, it is assumed that the surface to be cleaned is a carpet, which does not alter the fact that the unit 1 is applicable with other types of surfaces as well. In view of the intended use of the unit 1, the unit 1 will hereinafter also be referred to as vacuum cleaning unit 1.

For sake of completeness, it is noted that it is a well-known fact that a vacuum cleaning device serves for removing dust from a surface to be cleaned, which is normally a floor surface. Besides a nozzle for taking in the dust, a conventional vacuum cleaning device comprises means for inducing a suction force at the position of the nozzle and along an internal path from the nozzle to a point for collecting the dust, and means for separating dust from air. In many cases, the nozzle is connected to the dust collection point through suitable tubing.

FIG. 1 illustrates the fact that the vacuum cleaning unit 1 comprises a housing 10 having an internal space 11 enclosed by a housing wall 12. The housing 10 can have various shapes and sizes, depending on the particulars of an exact situation. In any case, at least one opening 13 is arranged in the housing wall 12, which can have various shapes and sizes as well. Also, there is a movable surface 30 which is integrated in the housing wall 12. In practical cases, the movable surface 30 can comprise a flexible membrane or the like, and can be part of a loudspeaker-like device, as diagrammatically shown in FIG. 2, or any other suitable type of device in which means for actuating the movable surface 30 are arranged. For example, the movable surface 30 may be an end surface of a piston, or a surface of piezo material.

When the vacuum cleaning unit 1 is operated and the means for actuating the movable surface 30 are made to perform their function, the movable surface 30 is moved at its position in the housing wall 12. The actuating means are adapted to realize a back and forth movement of the surface 30, such that an oscillating airflow is obtained. It is noted that in FIG. 1, the back and forth movement of the surface 30 is indicated by means of a two-headed arrow.

On the basis of the back and forth movement, incoming flows and outgoing flows of air are realized, but the back and forth movement alone does not generate a net airflow. During a blowing phase, i.e. a phase in which air is made to flow out of the opening 13, there is flow detachment at the position of the opening 13. Within the scope of the present invention, it is possible for the operation of the actuating means and the geometry of the housing 10 to be adapted to each other in such a way that the detached flow is realized with a sufficiently small Strouhal number, which is determined by a relation between a frequency of the movement of the surface 30, a characteristic dimension of the opening 13, and an average velocity of the air in the opening 13 in an outflow phase of a cycle of drawing in and expelling air, as follows:

$$Sr = \frac{f * d}{v}$$

in which Sr is the Strouhal number, f is the frequency as mentioned, d is the characteristic dimension as mentioned, and v is the velocity as mentioned. In case the opening 13 is an axis-symmetric opening, it is preferred if the following criterion is met: $Sr \leq 1$, and it is more preferred if the following criterion is met: $Sr \leq 0.5$, and in case the opening 13 has an elongated rectangular shape, it is preferred if the following criterion is met: $Sr \leq 0.25$, and it is more preferred if the following criterion is met: $Sr \leq 0.1$.

In respect of the average velocity v of the air in the opening 13, it is noted that in practice, the velocity can be expected to have a certain distribution over the opening 13, and to vary during an outflow phase of a cycle. Therefore, in practice, the velocity v may be determined as the velocity v which is found as the average of various values inside the opening 13, over an entire area of the opening 13, as an average during the outflow phase. The velocity v is determined by various factors, including characteristics of the vibrating motion of the surface 30 and geometry of the housing 10. In the context of this geometry, there are other determining factors, such as the size of the surface 30, the dimensions of the opening 13, and the volume of the internal space 11 of the housing 10. The velocity v can be determined in any suitable way, including using an algorithm or performing measurements. Hence, it is possible to design a vacuum cleaning unit 1 in which the criterion in respect of the Strouhal number Sr is met.

Figure 2:
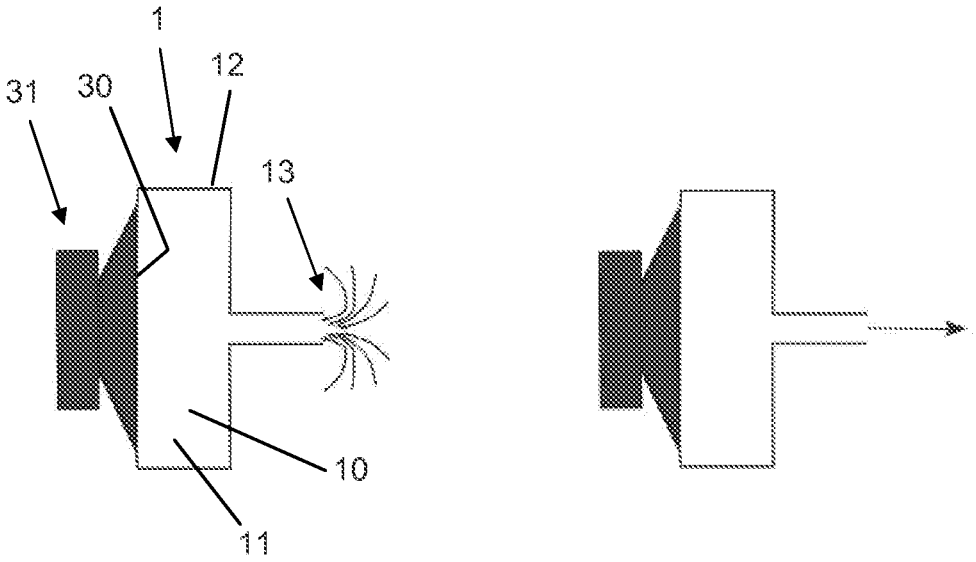
FIG. 2 illustrates an ingoing flow and an outgoing flow of air which are generated in two different stages of operation of the unit.

The vibrating motion of the surface 30 causes air to be alternately drawn into the internal space 11 of the housing 10 from the ambient, and expelled again into the ambient. By having a sufficiently small Strouhal number Sr, it is achieved that there is asymmetry between the suction and the blowing phases. This fact is illustrated in FIG. 2, in which directions of airflows are indicated by means of arrows. On the left side of FIG. 2, it can be seen that upon inflow, air is drawn from all directions into the internal space 11 of the housing, and on the right side of the FIG. 2, it can be seen that upon outflow, a directed jet of air is formed.

The oscillating jet flow is suitable to be used at the nozzle of a vacuum cleaning device to aerodynamically affect dust particles and/or the carpet, so that the dust is dislodged from the carpet and becomes airborne.

As far as the vacuum cleaning unit 1 is concerned, many variations on the basic implementation as described in the foregoing are feasible. In the following, only one of the many possible examples is mentioned. The housing 10 may have more openings 13, so that multiple jets can be created. The back of the movable surface 30 may be arranged in an airtight enclosure in order to raise its resonance frequency. Also, the back of the surface 30 can be coupled to one or more openings 13 in a housing 10 as well to create more jets. As the jets which are generated by the front and the back of the surface 30 are in anti-phase, the advantage of minimizing radiated sound is obtained. For the same purpose, multiple jets generated by multiple movable surfaces 30 driven in anti-phase can be employed. Conversely, a multitude of movable surfaces 30 may be contained in a single housing 10 and be coupled to a single opening 13.

Figure 3:
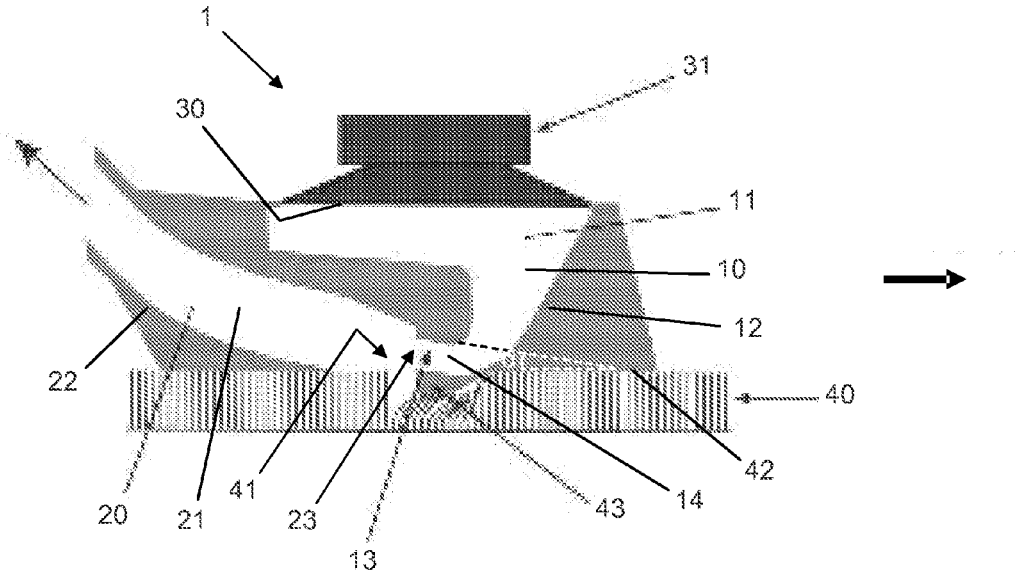
FIG. 3 diagrammatically shows a sectional view of a practical embodiment of the unit.

FIG. 3 serves to illustrate a practical embodiment of the vacuum cleaning unit 1. Basically, in this embodiment, the entirety of the movable surface 30 and the means for actuating the surface 30, which will hereinafter be referred to as synthetic jet generator 31, is used to suck up dust at inflow, and subsequently eject it towards a dust collection point such as a bag at jet outflow. The dust collection point is not shown in FIG. 3, but an arrow pointing in the direction of this point can be seen at the left side of the figure. A direction in which the unit 1 is preferably moved across the carpet 40 is indicated by means of an arrow which can be seen at the right side of the figure.

In the shown example, the vacuum cleaning unit 1 comprises two housings 10, 20, namely a housing 10 as described earlier, which is associated with the synthetic jet generator 31, and a housing 20 which is used for receiving a directed jet flow from the first-mentioned housing 10. For sake of clarity, the first housing 10 will be referred to as jet generator housing 10, and the second housing 20 will be referred to as suction channel housing 20. The jet generator housing 10 has the internal space 11, the housing wall 12, and the opening 13 in the housing wall 12 as described in the foregoing. In the shown example, the opening 13 is arranged at the end of a tube-shaped portion 14 of the housing 10, which will hereinafter be referred to as flow channel 14. The suction channel housing 20 has an internal space 21, a housing wall 22, and an opening 23 in the housing wall 22 that is in communication with the opening 13 of the jet generator housing 10. Thus, when a directed jet flow is expelled from the jet generator housing 10, the flow reaches the internal space 21 of the suction channel housing 20 through the openings 13, 23 as mentioned.

For the purpose of allowing air to flow from the carpet 40 to the inside of the vacuum cleaning unit 1, an opening 41 is arranged in the unit 1 that provides access to the internal space 21 of the suction channel housing 20 at a position that is in the immediate vicinity of the openings 13, 23 through which the internal spaces 11, 21 of the two housings 10, 20 are in communication with each other. In the following, the opening 41 that is the interface between the inside of the unit 1 and the outside of the unit 1 will be referred to as unit opening 41. A portion 42 of an exterior surface of the unit 1 which is used for facing the carpet 40 and allowing the unit 1 to be positioned right above the carpet 40 is planar, whereas at the position of the unit opening 41, a lip 43 which is projecting somewhat with respect to the planar area 42 in the direction of the carpet 40 is provided. During operation and movement of the unit 1, the lip 43 serves to open the carpet pile, thereby facilitating the escape of dust from the carpet.

Figure 4:
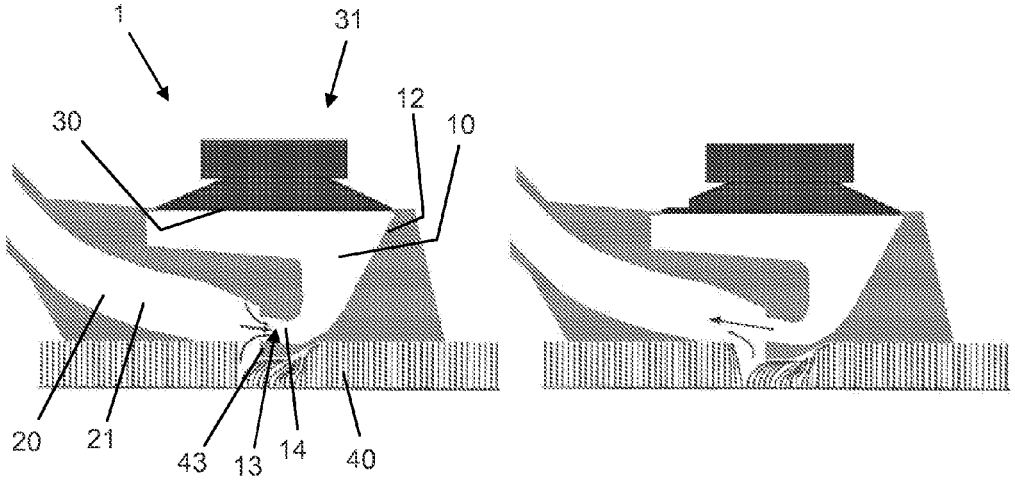
FIG. 4 illustrates flows of air which are generated during two different stages of operation of the unit shown in FIG. 3.

The flow channel 14, which has the opening 13 of the jet generator housing 10 at its end, extends just above the lip 43. During operation, the vibrating motion of the movable surface 30 that is incorporated in the housing wall 12 of the jet generator housing 10 establishes an oscillating flow in the flow channel 14. When air is drawn into that channel 14, is comes from all directions, as is depicted by means of arrows in the representation of the unit 1 on the left side of FIG. 4. When air is expelled again, flow separation causes it to flow out of the flow channel 14 as a directed jet, as is depicted by means of an arrow in the representation of the unit 1 on the right side of FIG. 4. The jet additionally entrains air from its surroundings, as indicated by another arrow in the representation of the unit 1 on the right side of FIG. 4.

When the movable surface 30 is made to perform a back and forth movement at its position in the housing wall 12 of the jet generator housing 10, dust is sucked out of the opened carpet pile into the flow channel 14 of the jet generator housing 10 during the intake phase, and ejected from the flow channel 14 into the internal space 21 of the suction channel housing 20, towards the dust collection point, during the jet outflow phase. Furthermore, during the jet outflow phase, entrainment causes additional dust to be removed out of the carpet 40. On average, no net airflow for dislodging dust is used. Only a small flow for dust transport from the unit opening 41 to the dust collection point, which may be induced by suitable means such as a fan (not shown) at the dust collection point, is required. This means that the flow through the carpet 40 and the system of the vacuum cleaning device (tubing, filters, etc.) is minimal, yielding substantially lower losses as compared to a traditional vacuum cleaning device in which one suction airflow is used for all processes which need to take place, including the removal of dust from a surface to be cleaned and the transport of the dust inside the device.

The present invention is especially applicable to the jet generator housing 10. A special feature is that at least a portion of the housing wall 12, particularly a portion in which the opening is located, is movably arranged in the vacuum cleaning unit 1, so that it is possible to vary the position of the opening 13 in the unit 1 and thereby vary the position of the opening 13 with respect to the carpet 40 and/or to vary an orientation of the portion of the housing wall 12 and thereby vary directions of incoming and outgoing airflows with respect to the carpet 40. For the purpose of moving the movably arranged portion of the housing wall 12 during operation of the vacuum cleaning unit 1, any suitable means (not shown) may be applied. Preferably, the vacuum cleaning unit 1 with the movably arranged portion of the housing wall 12 is designed and operated such as to have asymmetry between the suction and the blowing phases, in a way and with the effects as described in the foregoing, but this is not essential within the framework of the present invention.

In the following, examples are described in which the whole of the housing 10 is rotatable in the vacuum cleaning unit 1. That does not alter the fact that within the scope of the present invention, it can be so that only a portion of the housing wall 12 is movably arranged, provided that the opening 13 is present in that portion. Furthermore, that does not alter the fact that the portion of the housing wall 12 can be arranged such as to be movable in another way than by being rotatable. For example, the movably arranged portion of the housing wall 12 can be arranged such as to be capable to perform an oscillating movement, i.e. a back-and-forth movement when actuated.

Figure 5:
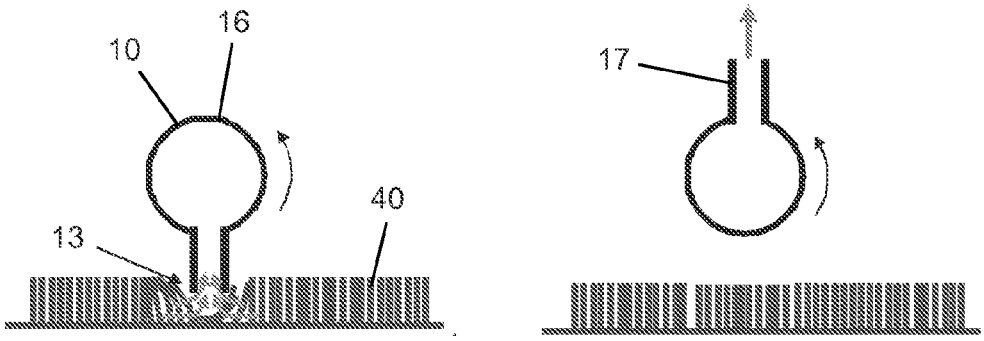
FIG. 5 diagrammatically shows a first option of the design of a movably arranged housing which is part of a unit adapted to function according to the principles of the present invention, wherein two possible positions of the housing are illustrated.

In a basic embodiment, the movably arranged housing 10 comprises a hollow cylinder having two end walls and a side wall extending between the end walls. FIG. 5 diagrammatically shows a cross-section of a generally cylinder-shaped housing 10. In the shown example, the side wall 16 of the housing 10 has a circular circumference. Furthermore, in the shown example, the movably arranged housing 10 also comprises a nozzle 17 which is arranged such as to protrude with respect to the side wall 16, wherein the opening 13 is arranged at a free end of the nozzle 17. The housing 10 is rotatable about a longitudinal axis of the side wall 16, as indicated by means of a curved arrow in FIG. 5.

The movable surface 30 for generating alternating incoming and outgoing airflows through the opening 13 is arranged in an end wall of the housing 10. During operation, the frequency and the phase of the airflow oscillation and the rotation of the housing 10 are matched in such a way that during the air intake phase, the nozzle 17 is directed towards the carpet 40 and dust is sucked up, while during the air outflow phase, when dust is ejected from the nozzle 17, the nozzle 17 is directed away from the carpet 40. The first situation is shown at the left side of FIG. 5, and the second situation is shown at the right side of FIG. 5. It is preferred if the housing 10 is positioned such that contact between the nozzle 17 and the carpet 40 is realized during the air intake phase, so that additional mechanical agitation of the carpet 40 is obtained.

Figure 6:
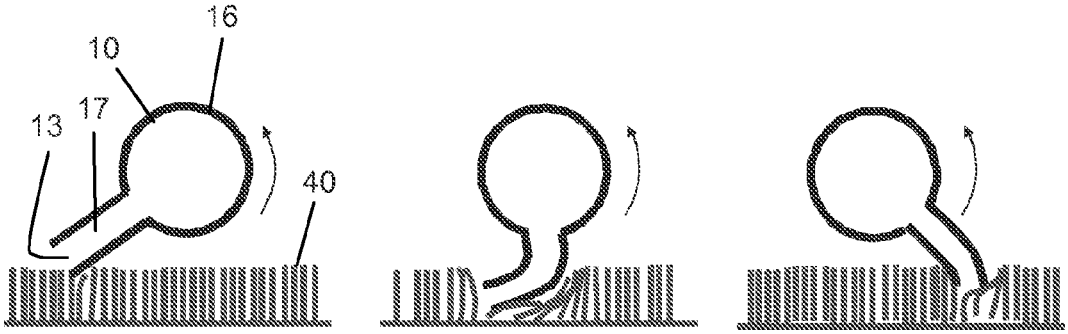
FIG. 6 illustrates a possibility of having a flexible outlet nozzle in the housing, wherein three possible positions of a housing with a flexible outlet nozzle are illustrated.

The nozzle 17 can be arranged along the entire side wall 16 of the housing 10, or at least along a substantial length thereof. Alternatively, multiple nozzles or other suitable components such as tubes can be used. Preferably, the nozzle 17 is of a flexible material, so that the mechanical agitation will not damage the carpet 40. The application of a flexible nozzle 17 is illustrated in FIG. 6. Another effect which is obtained when the nozzle 17 has flexible properties is that the period during which the nozzle 17 contacts the carpet 40 during the air intake phase is increased, which leads to increased effectiveness of the dust removal process. In FIG. 6, three successive angular positions of the housing 10 are shown, as seen from left to right, wherein it is shown that the flexible nozzle 17 more or less drags through the carpet 40, wherein the end portion with the opening 13 lags behind while the nozzle 17 is in a bent condition.

Figure 7:
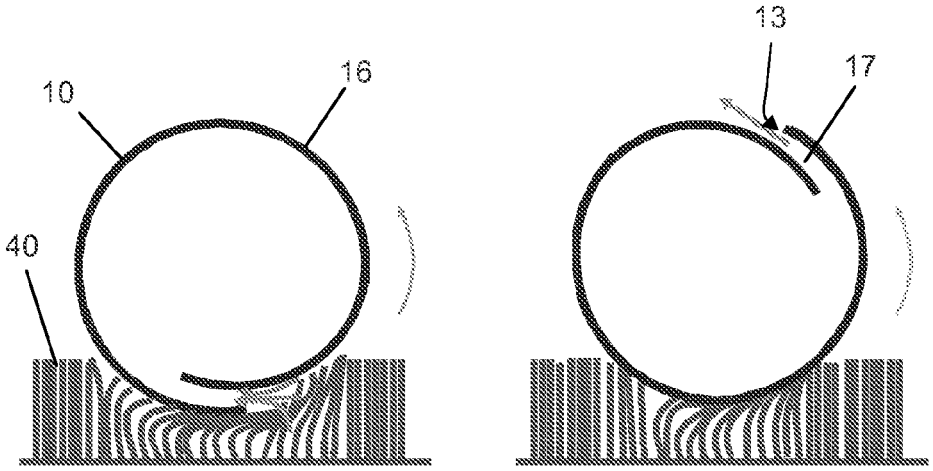
FIG. 7 diagrammatically shows an alternative option of the design of the movably arranged housing, wherein two possible positions of the housing are illustrated.
Figure 8:
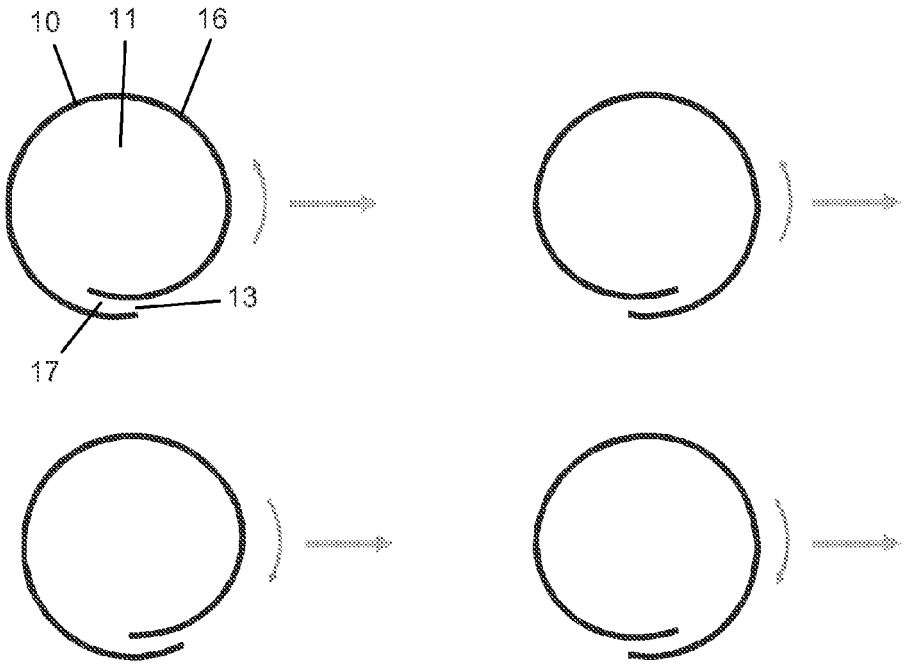
FIG. 8 illustrates four possibilities for the orientation and the direction of rotation and displacement of the housing shown in FIG. 7.

FIGS. 7 and 8 illustrate the fact that the nozzle 17 may be positioned tangentially with respect to the longitudinal axis of the side wall 16 of the housing 10, instead of radially as shown in FIGS. 5 and 6. The tangential positioning results in increased contact time between the nozzle 17 and the carpet 40 during the air intake phase. In this embodiment, mechanical agitation of the carpet 40 can be enhanced by additional brush-like hairs (not shown) on an external surface of the housing 10.

FIG. 7 shows two possible positions of the housing 10 with respect to the carpet 40, wherein each position is associated with another stage of the rotating movement of the housing 10 during operation. With the tangential position of the nozzle 17 as mentioned, it is possible to choose from different combinations of nozzle orientation and direction of rotation with respect to a direction of displacement across the carpet 40. This is illustrated in FIG. 8 for the embodiment shown in FIG. 7. In particular, FIG. 8 shows the following possibilities:

- on the left top side, rotating the housing 10 with the nozzle 17 directed forwards and displacing the housing 10 in such a direction that the nozzle 17 is protruding in a forward direction when being at the position which is closest to the carpet 40;
- on the right top side, rotating the housing 10 with the nozzle 17 directed backwards and displacing the housing 10 in such a direction that the nozzle 17 is protruding in a backward direction when being at the position which is closest to the carpet 40;
- on the left bottom side, rotating the housing 10 with the nozzle 17 directed backwards and displacing the housing 10 in such a direction that the nozzle 17 is protruding in a forward direction when being at the position which is closest to the carpet 40; and
- on the right bottom side, rotating the housing 10 with the nozzle 17 directed forwards and displacing the housing 10 in such a direction that the nozzle 17 is protruding in a backward direction when being at the position which is closest to the carpet 40.

The possibilities shown on the left top side and the right bottom side of FIG. 8 may be most preferred, as in those combinations of orientation of the nozzle 17 and movements, sucked-up dust is prevented from falling out of the nozzle 17. Furthermore, when the possibility shown on the left top side of FIG. 8 is applied, there is more resistance for the displacement along the carpet 40, as the direction of the rotation of the housing 10 is against the direction of the displacement of the housing 10. On the other hand, the degree of mechanical agitation of the carpet 40 is higher.

In the vacuum cleaning unit 1, any suitable means for actuating the movable surface 30 can be applied. For example, these means may be of the electro-dynamic type, and may comprise a loudspeaker. The actuating means/loudspeaker and the movable surface 30 may be allowed to move along with the housing 10, or a specific design is required to provide a sufficiently airtight connection between the movable surface 30 and the internal space 11 of the housing 10. Alternatively, one or both end walls of the cylinder wall can be a movable membrane, for example, which is mechanically driven by the movement of the housing 10 by using a cam construction or the like. This also provides the advantageous synchronization between the direction of the air flow and the position of the opening 13 with respect to a surface 40 to be cleaned.

It will be clear to a person skilled in the art that the scope of the present invention is not limited to the examples discussed in the foregoing, but that several amendments and modifications thereof are possible without deviating from the scope of the present invention as defined in the attached claims. While the present invention has been illustrated and described in detail in the figures and the description, such illustration and description are to be considered illustrative or exemplary only, and not restrictive. The present invention is not limited to the disclosed embodiments.

Variations to the disclosed embodiments can be understood and effected by a person skilled in the art in practicing the claimed invention, from a study of the figures, the description and the attached claims. In the claims, the word "comprising" does not exclude other steps or elements, and the indefinite article "a" or "an" does not exclude a plurality. The mere fact that certain measures are recited in mutually different dependent claims does not indicate that a combination of these measures cannot be used to advantage. Any reference signs in the claims should not be construed as limiting the scope of the present invention.

In this text, only the word "dust" is used for indicating particles that may be removed from a surface 40 to be cleaned by using the vacuum cleaning unit 1 according to the present invention. For sake of completeness, it is noted that the present invention is applicable for removing many types of particles, including particles which would normally be referred to than dirt particles rather than dust particles, and which are all assumed to be covered by the use of the word "dust" in this text.

A normal use of the vacuum cleaning device according to the present invention is a use in a normal environment, in which air is surrounding the device. Nevertheless, the present invention is also applicable in case another gas than air is present in the direct vicinity of the vacuum cleaning device. Therefore, it is noted that "air" in this text and the attached claims should be understood such as to represent any possible gas that can be used in the sucking/blowing action that is performed when the unit 1 which is part of the vacuum cleaning device according to the present invention is operated.

Within the scope of the present invention, the movably arranged portion of the housing wall 12 can be moved in any suitable way. In any design of the housing wall 12 in which it is possible to have a rotary movement, an oscillating movement is a possibility as well.

The present invention can be summarized as follows. A vacuum cleaning device comprises a unit 1 for aerodynamically affecting dust particles and/or a surface 40 to be cleaned in order for the particles to become dislodged from the surface 40 and to be received by the unit 1. The unit 1 comprises a housing 10 having an internal space 11 enclosed by a housing wall 12 in which at least one opening 13 is arranged, a movable surface 30 which is integrated in the housing wall 12, and means for actuating the movable surface 30, which are adapted to realize an oscillating movement of the surface 30 that causes air to alternately be drawn into the housing 10 through the opening 13, and expelled from the housing 10 through the opening 13. At least a portion of the housing wall 12, particularly a portion of the housing wall 12 in which the opening 13 is located, is movably arranged in the unit 1, so that the position of the opening 13 with respect to the surface 40 to be cleaned can be varied, wherein it is possible to relate an air intake phase of the operation of the movable surface 30 to a position in which the portion of the housing wall 12 in which the opening 13 is arranged is directed towards the surface 40, and to relate an air outflow phase of the operation of the movable surface 30 to a position in which the portion of the housing wall 12 in which the opening 13 is arranged is directed away from the surface 40. In this way, a situation in which dust particles may be blown back from the housing 10 towards the surface 40 is avoided, and the effectiveness of dust removal is increased.

Preferably, in the oscillating airflow which is realized by the movable surface 30 during operation, there is an asymmetry between the suction and the blowing phases, such that in the blowing phase a jet (air pulse) is generated. In particular, the jet can be realized when the so-called Strouhal number Sr, which is found when the frequency f of the movement of the movable surface 30 is multiplied by a characteristic dimension d of the opening 13, and divided by the velocity v of the air in the opening 13, is not higher than a predetermined maximum.

The present invention relates to a vacuum cleaning device which is equipped with a unit 1 for aerodynamically affecting dust particles and/or a surface 40 to be cleaned in order for the particles to become dislodged from the surface 40 and to be received by the unit 1, wherein the unit 1 comprises a housing 10 having an internal space 11 enclosed by a housing wall 12 in which at least one opening 13 is arranged, a movable surface 30 which is integrated in the housing wall 12, and means for actuating the movable surface 30, which are adapted to realize an oscillating movement of the surface 30 that causes air to alternately be drawn into the housing 10 through the opening 13, and expelled from the housing 10 through the opening 13, and wherein at least a portion of the housing wall 12, particularly a portion of the housing wall 12 in which the opening 13 is located, is movably arranged in the unit 1.

Furthermore, the present invention relates to a unit 1 for use in a vacuum cleaning device, for aerodynamically affecting dust particles and/or a surface 40 to be cleaned in order for the particles to become dislodged from the surface 40 and to be received by the unit 1, comprising a housing 10 having an internal space 11 enclosed by a housing wall 12 in which at least one opening 13 is arranged, a movable surface 30 which is integrated in the housing wall 12, and means for actuating the movable surface 30, which are adapted to realize an oscillating movement of the surface 30 that causes air to alternately be drawn into the housing 10 through the opening 13, and expelled from the housing 10 through the opening 13, wherein at least a portion of the housing wall 12, particularly a portion of the housing wall 12 in which the opening 13 is located, is movably arranged.

Also, the present invention relates to use in a vacuum cleaning device of a unit 1 which comprises a housing 10 having an internal space 11 enclosed by a housing wall 12 in which at least one opening 13 is arranged, wherein at least a portion of the housing wall 12, particularly a portion of the housing wall 12 in which the opening 13 is located, is movably arranged, and wherein the unit 1 further comprises a movable surface 30 which is integrated in the housing wall 12, and means for actuating the movable surface 30, which are adapted to realize an oscillating movement of the surface 30 that causes air to alternately be drawn into the housing 10 through the opening 13, and expelled from the housing 10 through the opening 13, for aerodynamically affecting dust particles and/or a surface 40 to be cleaned in order for the particles to become dislodged from the surface 40 and to be received by the unit 1.

The invention claimed is:

1. Vacuum cleaning device comprising a unit for aerodynamically affecting at least one of dust particles and a surface to be cleaned in order for the particles to become dislodged from the surface and to be received by the unit, said unit comprising:

a housing having an internal space enclosed by a housing wall in which at least one opening is located;

a movable surface which is integrated in the housing wall; and means for actuating the movable surface to effect an oscillating movement of said surface that causes air to alternately be drawn into the housing through the opening and expelled from the housing through the opening, where at least a portion of the housing wall in which the at least one opening is located is movably arranged in the unit.

2. Vacuum cleaning device according to claim 1 where the movably arranged portion of the housing wall and the movable surface are adapted to move cooperatively with each other.

3. Vacuum cleaning device according to claim 2 where the means for actuating the movable surface is adapted to produce an oscillating movement of the movable surface at a predetermined frequency and where the movably arranged portion of the housing wall is adapted to move repetitively at the same frequency.

4. Vacuum cleaning device according to claim 3 where the unit comprises means which are adapted to move along with the movably arranged portion of the housing wall and to mechanically transfer a substantial fraction of the movement to the movable surface.

5. Vacuum cleaning device according to claim 2 where the means for actuating the movable surface is adapted to produce an intermittent movement of the movable surface.

6. Vacuum cleaning device according to claim 2 where the movably arranged portion of the housing wall comprises a flexible component and where the opening is arranged in the flexible component.

7. Vacuum cleaning device according to claim 1 where means for agitating a surface to be cleaned during movement of the movably arranged portion of the housing wall is arranged on an external surface of the movably arranged portion of the housing wall.

8. Vacuum cleaning device according to claim 1 where the movably arranged portion of the housing wall is shaped like a cylinder wall having two end walls and a side wall extending between the end walls, where the opening is shaped like a slit extending along at least a substantial length of the side wall, and where the movable surface is arranged in one of the end walls.

9. Vacuum cleaning device according to claim 1 where the movably arranged portion of the housing wall is shaped like an assembly of a cylinder wall having two end walls and a side wall extending between the end walls and a tube-shaped element which is arranged on the side wall, where the opening is located at an end of the tube-shaped element and where the tube-shaped element has a substantially radial orientation with respect to a longitudinal axis of the cylinder wall.

10. Vacuum cleaning device according to claim 1 where the movably arranged portion of the housing wall is shaped like an assembly of a cylinder wall having two end walls and a side wall extending between the end walls and has a tube-shaped element which is arranged on the side wall, where the opening is located at an end of the tube-shaped element, and where the tube-shaped element has a substantially tangential orientation with respect to a longitudinal axis of the cylinder wall.

11. Vacuum cleaning device according to claim 1 where the actuating means is adapted to effect an oscillating movement of the movable surface that causes air to alternately be drawn into the housing through the opening from various directions at the opening and expelled from the housing through the opening in the form of a directed jet.

12. Vacuum cleaning device according to claim 11 where the actuating means is adapted to effect a movement of the movable surface with characteristics for ensuring that the following criterion is met:

$$\frac{f * d}{v} \leq 1$$

in which f is a frequency of the movement of the surface, d is a characteristic dimension of the opening, and v is an average velocity of the air in the opening in an outflow phase of a cycle of drawing in and expelling air.

13. Unit for use in a vacuum cleaning device for aerodynamically affecting at least one of dust particles and a surface to be cleaned in order for the particles to become dislodged from the surface and to be received by the unit, said unit comprising:

a housing having an internal space enclosed by a housing wall in which at least one opening is located, a movable surface which is integrated in the housing wall; and means for actuating the movable surface to effect an oscillating movement of said surface that causes air to alternately be drawn into the housing through the opening and expelled from the housing through the opening, where at least a portion of the housing wall in which the at least one opening is located, is movably arranged.

14. Unit according to claim 13 where the movably arranged portion of the housing wall and the movable surface are adapted to move cooperatively with each other.

* * * * *